US011485597B2

(12) United States Patent
Boland et al.

(10) Patent No.: US 11,485,597 B2
(45) Date of Patent: Nov. 1, 2022

(54) DRYER ROLLERS OF A PRINT SYSTEM WITH INCREASING CONTACT AREA

(71) Applicants: Stuart J. Boland, Denver, CO (US); Scott R. Johnson, Erie, CO (US); Wataru Sakamoto, Boulder, CO (US)

(72) Inventors: Stuart J. Boland, Denver, CO (US); Scott R. Johnson, Erie, CO (US); Wataru Sakamoto, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 375 days.

(21) Appl. No.: 16/722,474

(22) Filed: Dec. 20, 2019

(65) Prior Publication Data

US 2021/0188586 A1 Jun. 24, 2021

(51) Int. Cl.

| | |
|---|---|
| ***F26B 13/08*** | (2006.01) |
| ***B65H 20/02*** | (2006.01) |
| ***B41J 11/00*** | (2006.01) |
| ***B41J 11/04*** | (2006.01) |
| ***B65H 20/10*** | (2006.01) |
| ***B65H 23/192*** | (2006.01) |
| ***F26B 13/14*** | (2006.01) |
| ***F26B 3/20*** | (2006.01) |
| ***F26B 13/18*** | (2006.01) |

(52) U.S. Cl.

CPC ..... *B65H 20/02* (2013.01); *B41J 11/002* (2013.01); *B41J 11/007* (2013.01); *B41J 11/04* (2013.01); *B65H 20/10* (2013.01); *B65H 23/192* (2013.01); *F26B 3/20* (2013.01); *F26B 13/14* (2013.01); *F26B 13/18* (2013.01)

(58) Field of Classification Search

CPC ..... B65H 20/02; B65H 20/10; B65H 23/192; B41J 11/002; B41J 11/007; B41J 11/04; B41J 11/0024; F26B 3/20; F26B 13/14; F26B 13/18; F26B 13/08

USPC ..... 34/620, 616, 618, 619, 624, 645

See application file for complete search history.

(56) References Cited

U.S. PATENT DOCUMENTS

| | | | |
|---|---|---|---|
| 5,921,453 | A | 7/1999 | Suzuki |
| 8,398,802 | B2 | 3/2013 | Kohler |
| 9,702,624 | B2 | 7/2017 | Toya et al. |
| 10,060,675 | B2 | 8/2018 | Boland et al. |

(Continued)

FOREIGN PATENT DOCUMENTS

| | | | |
|---|---|---|---|
| DE | 4220682 | C1 | 12/1993 |
| EP | 3360687 | A1 | 8/2018 |
| JP | 2017207250 | A | 11/2017 |

OTHER PUBLICATIONS

European Search Report; Application 20212714.8; dated Apr. 26, 2021.

(Continued)

*Primary Examiner* — John P McCormack

(74) *Attorney, Agent, or Firm* — Duft & Bornsen, PC

(57) ABSTRACT

Systems and methods for dryer rollers of a print system with increasing wrap angles. In one embodiment a dryer includes a turning device configured to rotate about an axis, and to guide a web of print media. The dryer also includes rollers configured to transport the web from an entrance of the dryer to the turning device. The rollers include a series of three or more rollers positioned in the dryer to consecutively increase an amount of contact area with the web as the web travels toward the turning device.

30 Claims, 8 Drawing Sheets

(56) References Cited

U.S. PATENT DOCUMENTS

| | | | | |
|---|---|---|---|---|
| 10,065,433 | B1 | 9/2018 | Boland et al. | |
| 10,081,198 | B2 | 9/2018 | Boland et al. | |
| 10,384,472 | B2 | 8/2019 | Onodera et al. | |
| 2004/0191419 | A1* | 9/2004 | Oki | F26B 25/006 427/372.2 |
| 2012/0039646 | A1 | 2/2012 | Condello et al. | |
| 2016/0313059 | A1* | 10/2016 | Boland | F26B 13/18 |
| 2017/0096017 | A1* | 4/2017 | Fernando | B41J 11/0005 |

OTHER PUBLICATIONS

Ajit K. Ghosh; Fundamentals of Paper Drying—Theory and Application from Industrial Perspective; Australia; ww.intechopen.com.

Manual of Operation, Maintenance and Parts for Model 761/762 and Model 771; S & S Corrugated Paper Machinery Co., Inc.; Mar. 1976.

* cited by examiner

DRYER ROLLERS OF A PRINT SYSTEM WITH INCREASING CONTACT AREA

TECHNICAL FIELD

The invention relates to the field of printing systems, and in particular, to dryers of printing systems.

BACKGROUND

Businesses or other entities having a need for volume printing typically use a production printing system capable of printing hundreds of pages per minute. A web of print media, such as paper, is stored in the form of a large roll and unraveled as a continuous sheet. During printing, the web is quickly passed underneath printheads which discharge small drops of ink at particular intervals to form pixel images on the web. The web may then be dried and cut to produce a final printed product. Since production printers output high quality images at high speed, it is important that the drying process of the web is quick, effective, and efficient.

SUMMARY

Embodiments described herein provide dryer rollers of a print system with increasing contact area. After initially entering the dryer, a web of print media contacts initial rollers for a short distance/time. The contact area of the web with respect to subsequent dryer rollers gradually increases as the web travels through the dryer. Advantageously, the configuration utilizes the available heating power of the dryer rollers more efficiently by balancing heating duty cycle among the rollers.

One embodiment is a system that includes a dryer of a printing system. The dryer includes a turning device configured to rotate about an axis, and to guide a web of print media. The dryer also includes rollers configured to transport the web from an entrance of the dryer to the turning device. The rollers include a series of three or more rollers positioned in the dryer to consecutively increase an amount of contact area with the web as the web travels toward the turning device.

Another embodiment is a web handling system. The web handing system includes a turning device configured to rotate about an axis, and to guide a web of print media. The web handling system also includes rollers configured to transport the web from an entrance to the turning device. The rollers include a series of three or more rollers to consecutively increase an amount of contact area with the web as the web travels toward the turning device.

Yet another embodiment is a method of heating a web of print media. The method includes providing a turning device to guide the web in a dryer of a printer. Method further includes positioning rollers in the dryer to define a path for the web along the arc between an entrance of the dryer and the turning device. Method also includes increasing an amount of contact area of the web with three or more of the rollers as the web travels toward the turning device.

Yet another embodiment is a system that includes a dryer of a printing system. The dryer includes a turning device configured to rotate about an axis, and to guide a web of print media. The dryer also includes rollers configured to transport the web from an entrance of the dryer to the turning device. In one embodiment, the rollers are positioned such that an amount of contact area between the web and individual ones of the rollers increases on a moving average basis as the web travels toward the turning device. In another embodiment, each of the rollers consecutively increase an amount of contact area with the web as the web travels toward the turning device.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other example embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
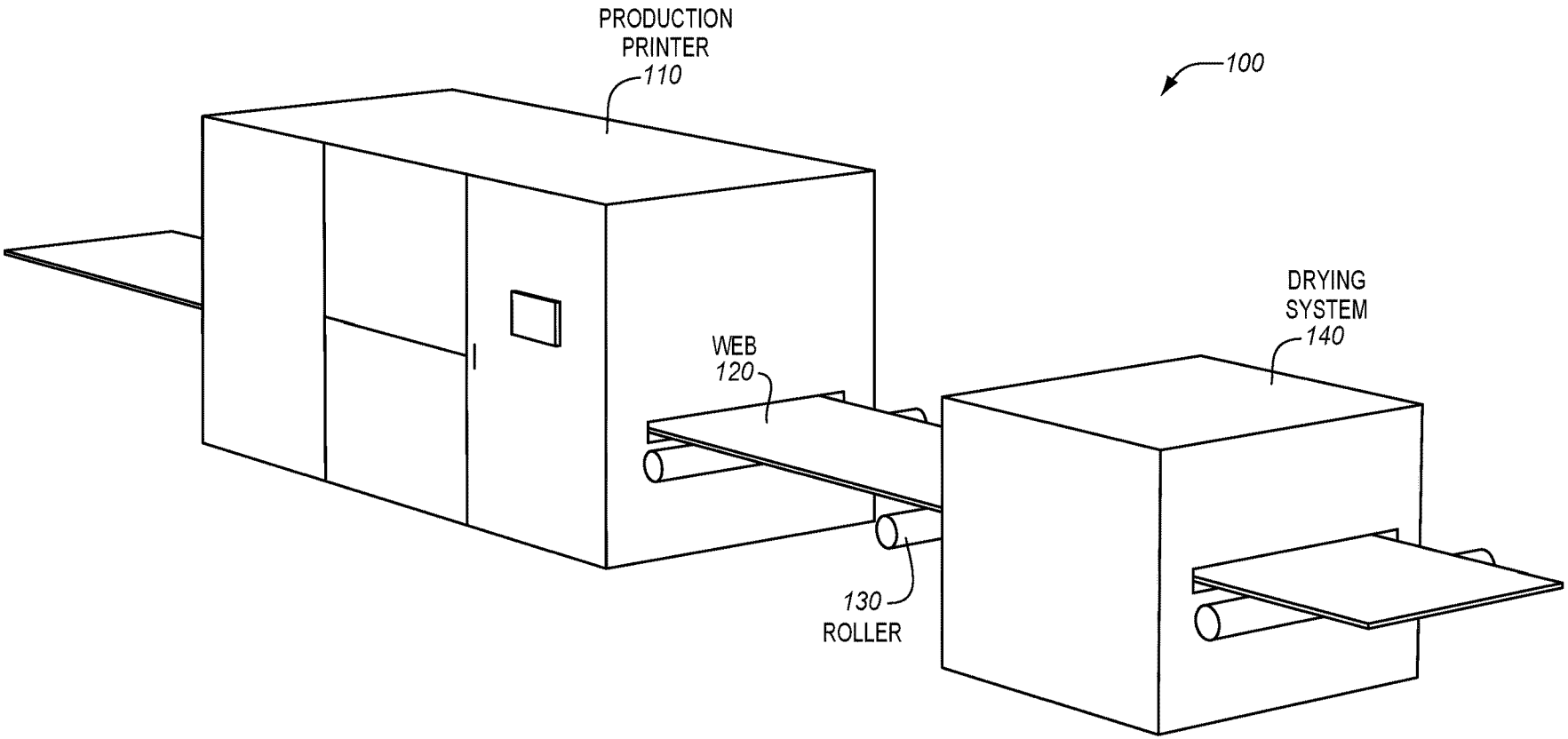
FIG. 1 illustrates an example continuous-forms printing system.

FIG. 1 illustrates an example continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). The printer 110 may comprise an inkjet printer that applies colored inks, such as Cyan (C), Magenta (M), Yellow (Y), Key (K) black, white, or clear inks. The ink applied by the printer 110 onto the web 120 is wet, meaning that the ink may smear if it is not dried before further processing. One or more rollers 130 position the web 120 as it travels through the printing system 100. The printing system 100 also includes drying system 140 to dry ink applied to the web 120. The web 120 exits the printer and is transported to the drying system 140 where it is received by the drying system 140. The printer 110 is upstream from the dryer since the web 120 travels downstream from the printer 110 to the drying system 140. The printer 110 and drying system 140 may be separate devices or an integrated system.

Figure 2:
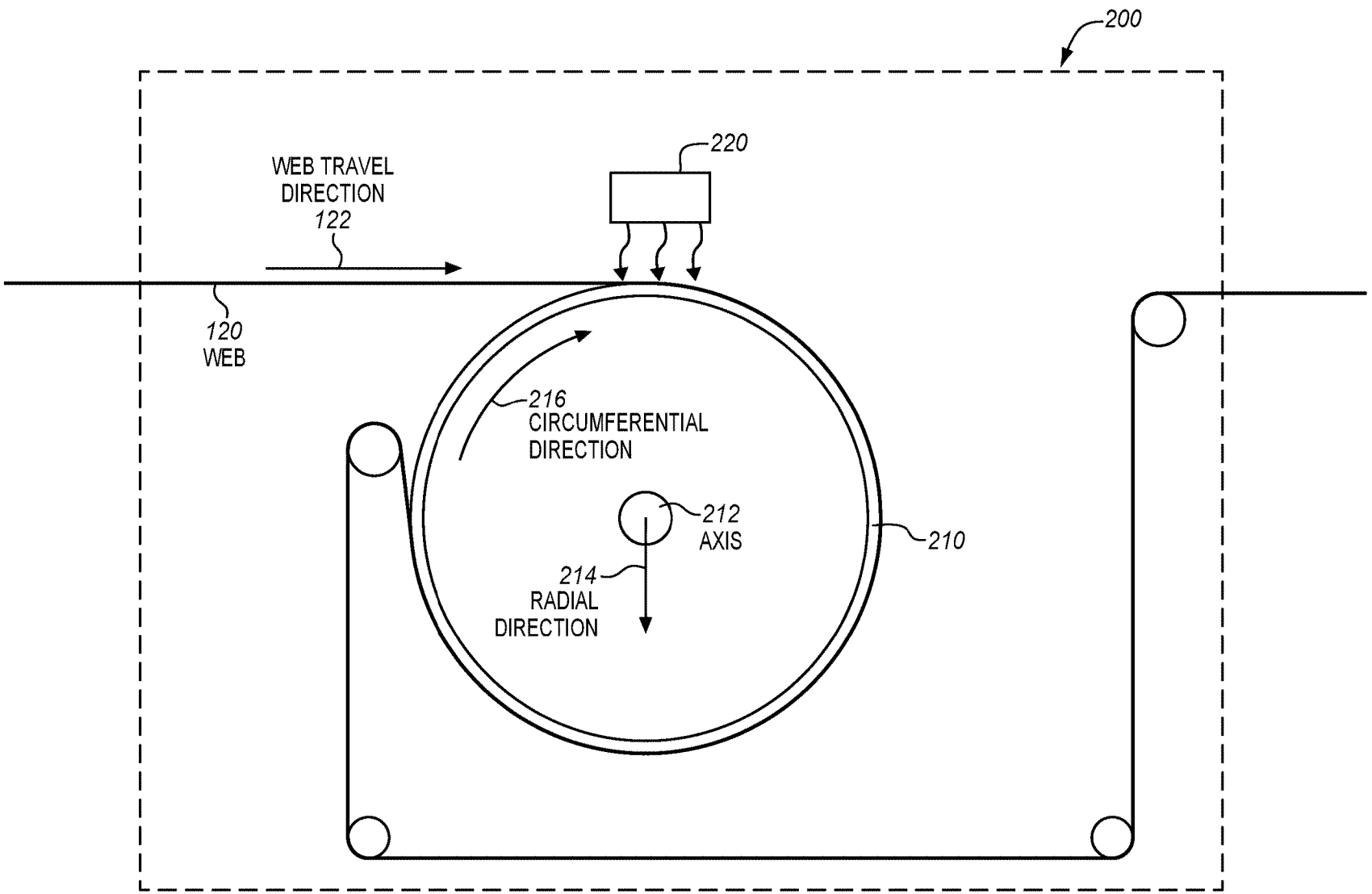
FIG. 2 illustrates a side view of a dryer.

FIG. 2 illustrates a side view of a dryer 200. The dryer 200 includes drum 210 comprising a cylindrical body with a thermally conductive surface on its outer circumference. During operation, the web 120 is marked with ink by a print engine, enters dryer 200 as it travels along web travel direction 122, and wraps around an outer surface of the rotating drum 210, which is heated to a desired temperature via heat transfer of a radiant energy source 220 (which may be positioned external to drum 210 as shown and/or positioned internally in an area inside drum 210). The drum 210 rotates about axis 212, and components of dryer 200 may therefore be described with respect to a radial direction 214 which is any direction along a straight line from axis 212 or center of the drum 210, and a circumferential direction 216 which is analogous to a rotational direction of the drum 210 that is perpendicular to the radial direction 214. Although the drum 210 provides consistent and even heating of the web 120, conventional drying systems such as that shown in FIG. 2 have a relatively low degree of drying adaptability since the total path length of the web 120 is constant and relatively short and drying adjustments are limited to simply increasing/decreasing heat output of the radiant energy source 220 for corresponding temperature changes on surface of the drum 210.

Figure 3:
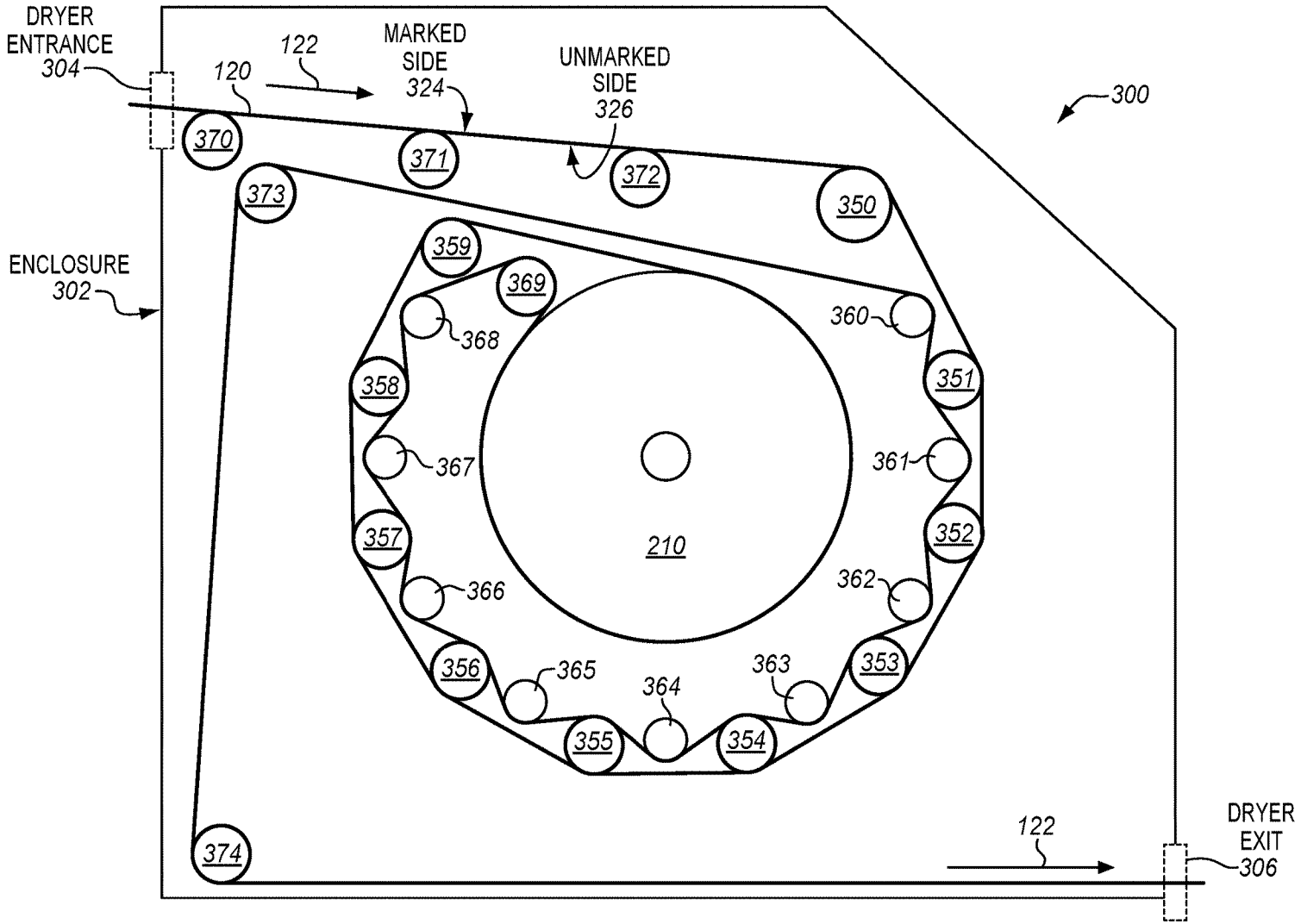
FIG. 3 illustrates a side view of another dryer.

FIG. 3 illustrates a side view of another dryer 300. The dryer 300 includes two groups of rollers: a series of first rollers 350-359 spaced along an arc around drum 210, and a series of second rollers 360-369 spaced along the arc around drum 210. The drum 210 is generally positioned inside the arc and has a larger circumference than rollers 350-359/360-369.

After printing, the web 120 enters an enclosure 302 of dryer 300 at the dryer entrance 304 with a marked side 324 that is wet with an applied ink and an unmarked side 326 that does not have ink (or which has been previously marked and already dried). The web 120 may travel over one or more entrance rollers 370-372 before encountering the first rollers 350-359. The first rollers 350-359 transport (i.e., guide) web 120 along a first path of the arc in a first direction (e.g., clockwise direction or first circular direction). One or more of the first rollers 350-359 may be heated internally or externally for drying ink applied to the web 120. A roller (e.g., roller 359) among the first rollers 350-359 which is last along the arc turns web 120 toward drum 210. The web 120 then wraps around a circumferential portion of the drum 210 which applies further heat to the web 120.

After traveling around the drum 210, the web 120 encounters the second rollers 360-369. A roller (e.g., roller 369) among the second rollers 360-369 which is first to receive the web 120 from the drum 210 may be positioned adjacent to the last roller (e.g., roller 359) of the first rollers 350-359. Accordingly, rollers 369/359 may tension/transport the web 120 around a substantial circumferential portion of the drum 210 (e.g., wrap/contact angle of 300 degrees or more). The second rollers 360-369 transport web 120 along a second path of the arc in a second direction which is generally opposite from the first direction (e.g., counter-clockwise direction or a second circular direction opposite to the first circular direction). The second rollers 360-369 are positioned along the arc and radially between the first rollers 350-359 and the drum 210. After traveling the arc again in the reversed (i.e., opposite) direction, the web 120 may travel over one or more exit rollers 373-374 before leaving dryer 300 through the dryer exit 306 of the enclosure 302.

Although this configuration provides an increased path length in comparison with conventional drum-only dryers (and therefore an increased number of options for conditioning web with precise control), the increased number of heated elements may result in increased system power rating. Moreover, there may be an imbalance of power consumption across the rollers 350-359/360-369 and it may be difficult to define the correct temperature settings that achieve a desired heat profile of the web 120.

For example, initial heated rollers (e.g., first rollers 351-352) may consume power at a high rate to transfer heat to web 120 near room temperature, and later heated rollers (e.g., first rollers 357-359) may consume power at a low rate since web 120 is at a high temperature by the time it reaches those rollers. Moreover, it may be desirable for first rollers 350-359 to comprise common components (e.g., to make installation/maintenance of the dryer 300 easier) and thus have the same power output capability. However, if each of the first rollers 350-359 have relatively high output to match the capability for the initial rollers (e.g., first rollers 351-352) then some of the later rollers (e.g., first rollers 357-359) may be oversized for their use, resulting in the dryer 300 having a high system power rating but with relatively low utilization. Alternatively, if each of the first rollers 350-359 have relatively low output to match the capability for the later rollers (e.g., first rollers 357-359) then the initial rollers (e.g., first rollers 351-352) may not apply enough heat as desired for the heat profile of web 120.

Figure 4:
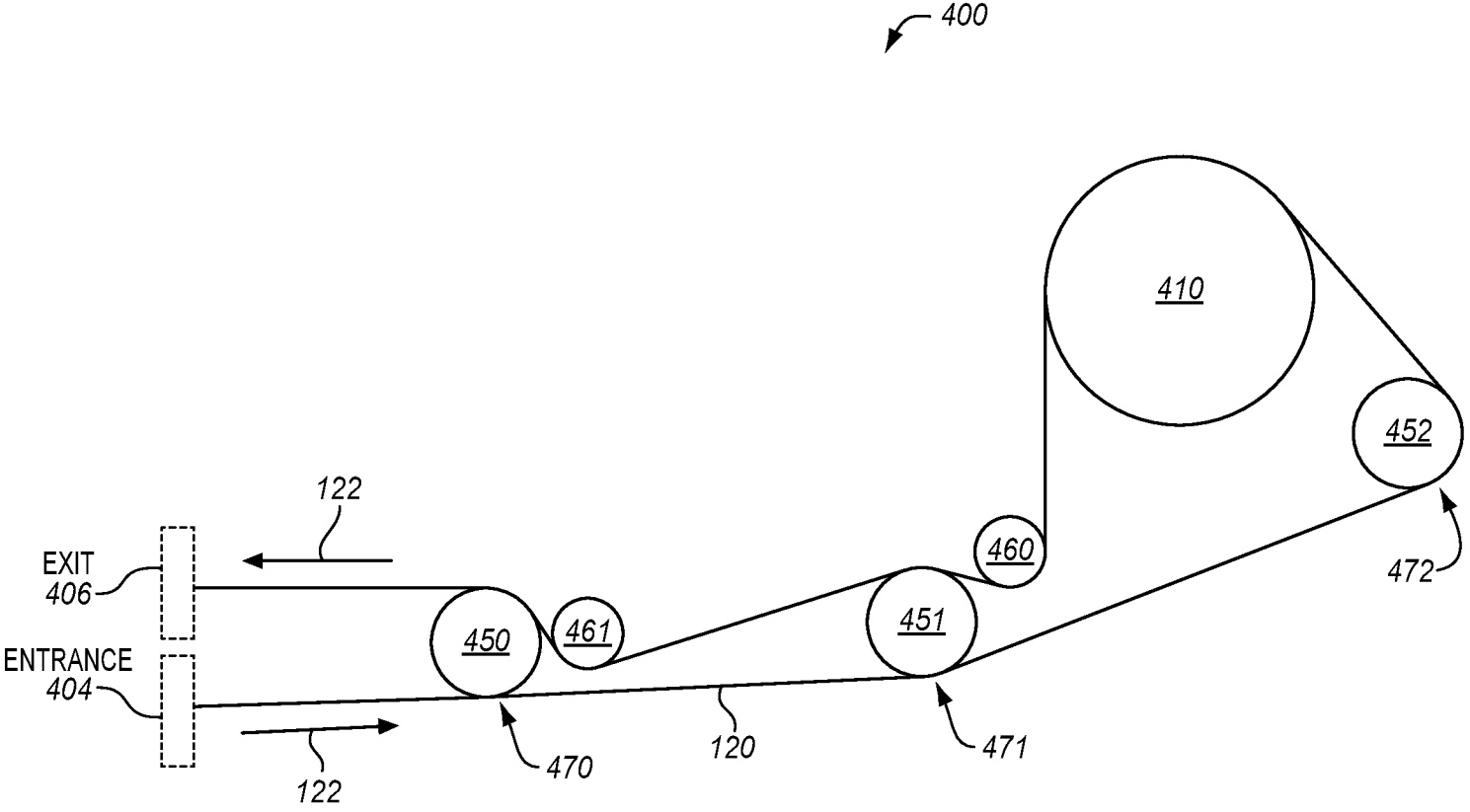
FIG. 4 is a diagram of a web handling system with rollers having an increasing web contact area in an illustrative embodiment.

FIG. 4 is a diagram of a web handling system 400 with rollers having an increasing web contact area in an illustrative embodiment. The web handling system includes a turning device 410, rollers 450-452, and supports 460-461. The rollers 450-452 are configured to transport the web 120 from an entrance 404 to the turning device 410. The web 120 wraps around the turning device 410 and is tensioned by supports 460-461 that guide/transport the web 120 from the turning device 410 to an exit 406. The turning device 410 may comprise any device configured to change the traveling direction 122 of the web 120. The turning device 410 may be configured to rotate about an axis and/or heat and/or guide the web 120. In some embodiments, the turning device 410 comprises a drum similar to the drum 210 described above. Similarly, the rollers 450 may comprise heated rollers to dry ink applied to the web 120 similar to the first rollers 350-359 described above.

The rollers 450-452 are arranged or spaced in a different configuration than that of the first rollers 350-359 of the dryer 300 described above. In particular, the rollers 450-452 are positioned such that a contact area of the web 120 increases for each subsequent roller 450-452 as the web 120 travels toward the turning device 410. In this context, a contact area is a circumferential contact area between the web 120 and one of the rollers 350-352. Contact area between web 120 and a roller is based on a wrap angle, the radius (or diameter) dimension of the roller and the width dimension of the web in contact with the roller. With a set of rollers that have a common radius and a web of fixed width, the contact area is then proportional to the wrap angle. For example, the web 120 has a relatively small first contact area 470 around initial roller 450 (e.g., nearest to entrance 404), a medium second contact area 471 around intermediate roller 451, and a relatively large third contact area 472 around last roller 452 (e.g., nearest to turning device 410). The rollers 450-452 are thus positioned such that a contact area of the web 120 increases for each subsequent roller as the web 120 travels toward the turning device 410.

This configuration enables improved power consumption and an improved heating profile of the web 120. For example, the initial roller 450 is able to operate with moderate power consumption because its limited contact area 470 (and therefore contact time) restricts the amount of heat transfer to the web 120 at a time in which the web 120 is at a relatively low temperature (e.g., room temperature). The last roller 452 is also able to operate with moderate power consumption because, although the web 120 has increased temperature and is closer in temperature to the last roller 452 as it initiates contact, the increased contact distance/time of contact area 472 enables the last roller 452 to impart a similar amount of heat transfer as that of the initial roller 450. By contrast, the dryer 300 of FIG. 3 is configured such that first rollers 350-359 each have similar contact areas and contact times with the web 120 regardless as to the increasing temperature of the web 120 as it travels through the dryer 300. By starting with a short contact time on rollers 450-452 and gradually increasing contact time as the web 120 travels across successive rollers toward the turning device 410, the rollers 450-452 may comprise common components with the same heat/power capabilities to improve the heating profile of the web 120 versus power of each roller 450-452. In one embodiment, the rollers 450-452 include a series of three or more rollers positioned in the web handling system 400 to consecutively increase an amount of contact area with the web 120 as the web 120 travels toward the turning device 410 to gradually heat the web 120 with improved power consumption and heat profile.

After wrapping/turning around the turning device 410, the web 120 is tensioned by supports 460-461 as the web 120 travels from the turning device 410 to the exit 406. The supports 460-461 may comprise any element suitable to guide/tension the web 120. The supports 460-461 reverse the path of the web 120 between the turning device 410 and the exit 406. In some embodiments, the rollers 450-452 comprise first rollers, and the supports 460-461 comprise second rollers. In some embodiments, the supports 460-461 are curved surfaces suitable for guiding web 120 as it travels. As shown in FIG. 4, the supports 460-461 may be positioned relative to the rollers 450-452 to cause the web 120 to contact the rollers 450-452 again as it travels in the opposite direction. That is, the web 120 contacts a first circumferential portion (e.g., front portion) of each of the rollers 450-452 as it travels toward the turning device 410 and a second circumferential portion (e.g., back portion) of each of the rollers 450-452 as it travels away from the turning device 410 toward the exit 406.

Figure 5:
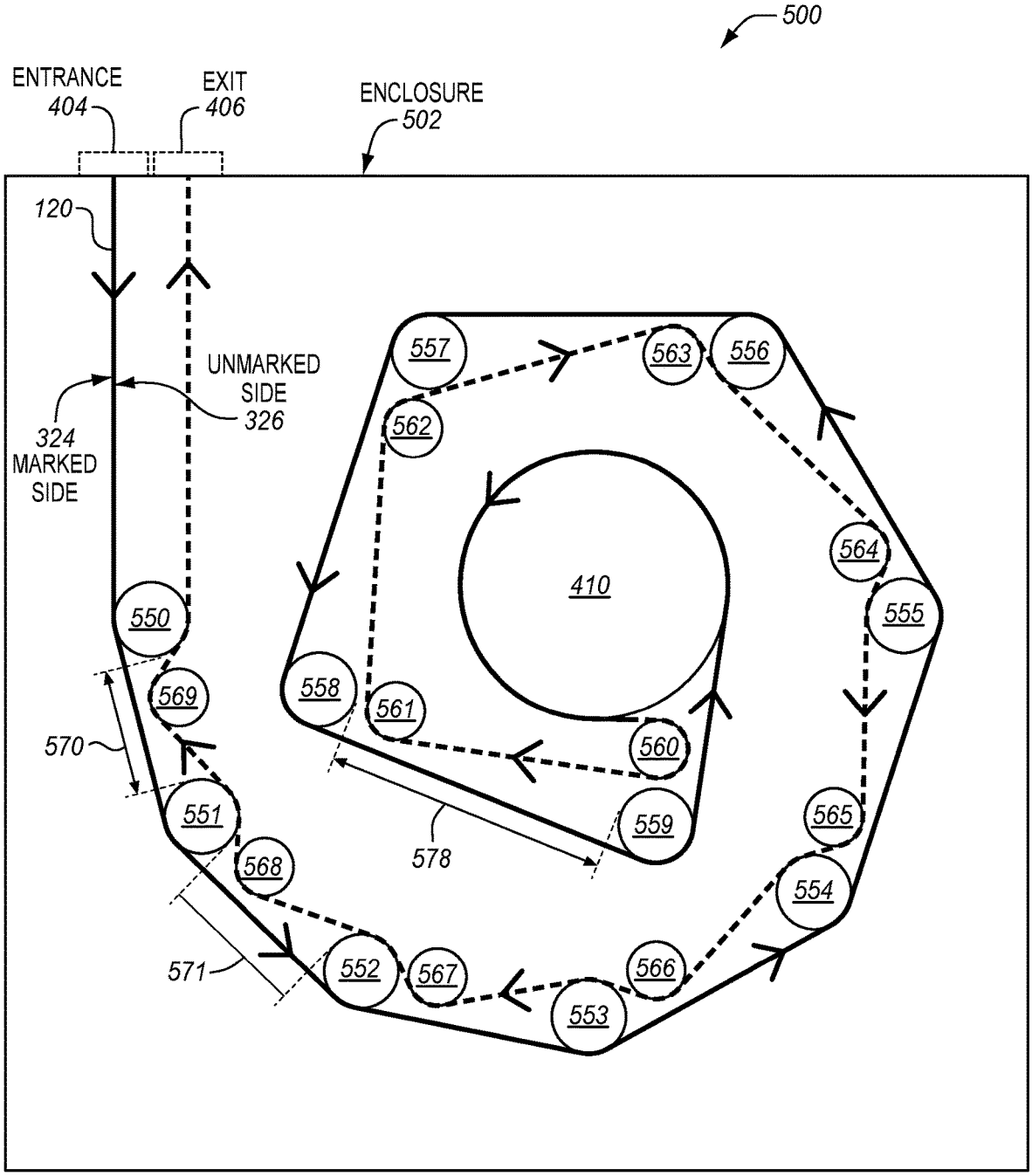
FIG. 5 is a diagram of a dryer with rollers having an increasing web contact area in an illustrative embodiment.

FIG. 5 is a diagram of a dryer 500 with rollers having an increasing web contact area in an illustrative embodiment. The dryer 500 includes an enclosure 502, rollers 550-559, the turning device 410, and supports 560-569. After entering the dryer 500 through an entrance 404, the web 120 encounters initial roller 550 and then subsequent rollers 551-559 in sequential order before wrapping around the turning device 410. The contact area of the web 120 around initial roller 550 is relatively low (e.g., less than ten degrees around its circumference) and increases with each successive roller such that its contact area around a last roller 559 prior to the turning device 410 is relatively high (e.g., more than a hundred degrees around its circumference). As shown in this example, in some embodiments, each and/or every roller 550-559 may consecutively increase an amount of contact area with the web 120 as the web 120 travels toward the turning device 410. In some embodiments, the number of rollers 550-559 in the dryer 500 is an integer between three and twelve inclusive.

Additionally, as shown in FIG. 5, the rollers 550-559 may be positioned relative to one another such that a distance between adjacent ones of the rollers 550-559 increases as the web 120 travels toward the turning device 410. That is, a first distance 570 between rollers 550-551 is smaller than a second distance 571 between rollers 551-552, and so on, until a largest third distance 578 between rollers 558-559. Accordingly, there is an increasing dwell time (e.g., non-heating time) of the web 120 as it travels across the rollers 550-559 toward the turning device 410. This advantageously elevates the temperature of the web 120 (and ink applied thereto) earlier in the drying process as compared to the dryer 300 to achieve improved drying for similar system power.

As also shown in FIG. 5, the rollers 550-559 may be positioned along one or more arcs (e.g., a spiral pattern composed of multiple arcs) around the turning device 410 to define a path for the web 120 along the arc between the entrance 404 of the dryer 500 and the turning device 410. The supports 460-469 may be positioned along the arc and radially between the rollers 550-559 and the turning device 410. The rollers 550-559 may thus define the path of the web 120 along the arc in a first circular direction, and the supports 560-569 may define the path of the web 120 along the arc in a second circular direction opposite to the first circular direction.

Positions of the supports 560-569 may correspond with the positions of the rollers 550-559. For example, support 560 corresponds with roller 559, support 561 corresponds with 558, and so on. Thus, the supports 560-569 may be positioned relative to one another such that a distance between adjacent ones of the supports 560-569 decreases as the web 120 travels from the turning device 410 and toward the exit 406 of the dryer 500. Furthermore, the supports 560-569 may be positioned relative to the rollers 550-559 such that an amount of contact area of the web 120 with the second circumferential portion of each of the rollers 550-559 increases for each subsequent roller as the web 120 travels from the turning device 410 and toward the exit 406 of the dryer 500. That is, the web 120 contacts a second circumferential portion of roller 559 a relatively small amount and gradually increases contact for subsequent rollers until it contacts a second circumferential portion of roller 550 a relatively large amount. The increasing contact/heat time of the web 120 with respect to the second pass across rollers 550-559 advantageously enables the web 120 to transfer heat back into the dryer 500 as it exits the dryer 500 with increasing temperature setpoints to reduce the output temperature of the web 120 and further improve drying efficiency.

Figure 6:
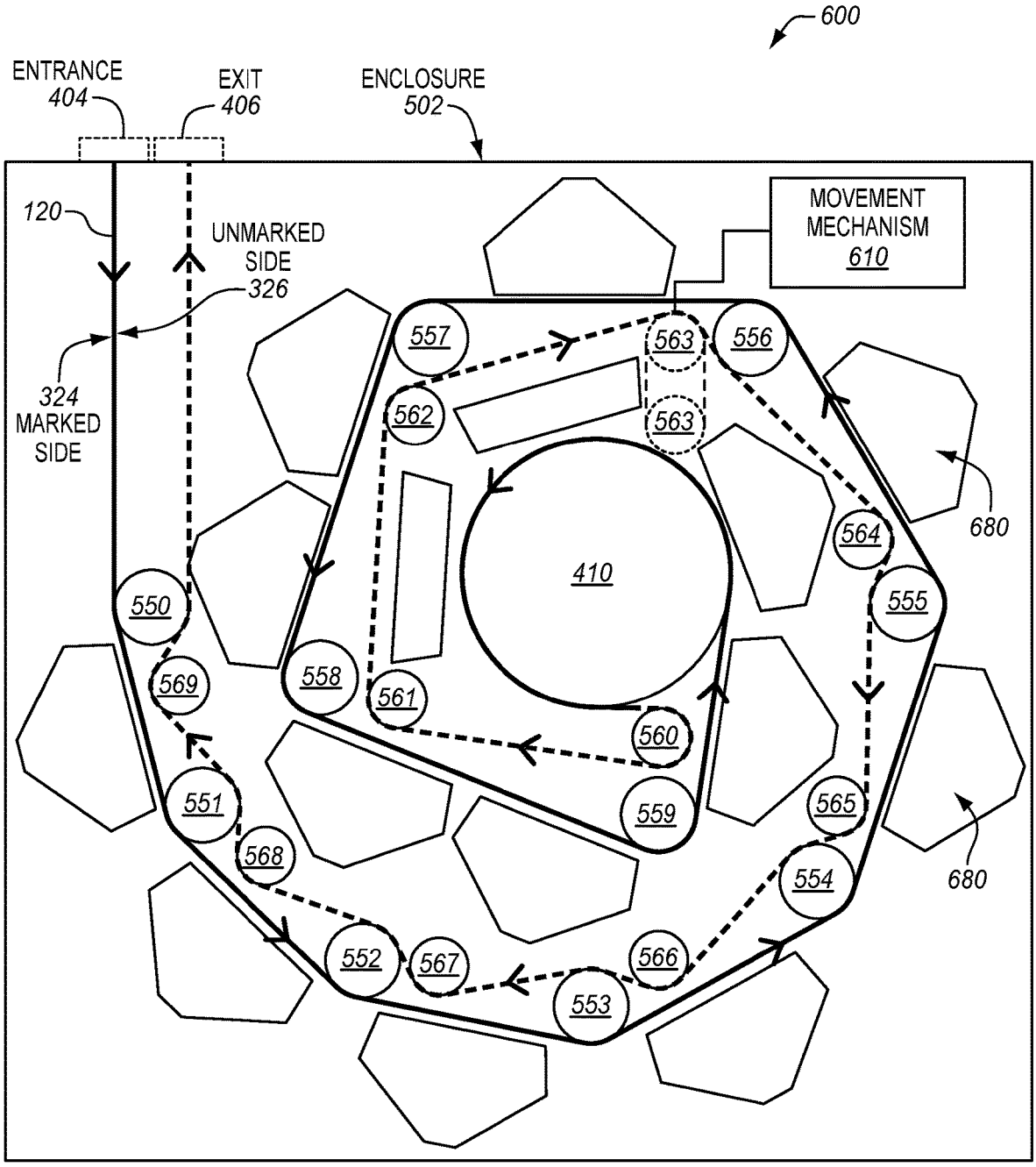
FIG. 6 is a diagram of a dryer with rollers having an increasing web contact area in another illustrative embodiment.

FIG. 6 is a diagram of a dryer 600 with rollers having an increasing web contact area in another illustrative embodiment. In particular, FIG. 6 shows that one or more of the supports 560-569 (e.g., support 563) may be configured to adjust position relative to a roller (e.g., corresponding roller 556) to change an amount of contact area of the web 120 with the second circumferential portion of the roller. The dryer 600 may thus include one or more movement mechanism(s) 610 coupled to supports 560-569 to adjust physical location of supports 560-569 relative to corresponding rollers 550-559 producing an adjustment to an amount of interlacing therebetween. Movement mechanism 610 may include a screw, lever, linear actuator, motor, gears and/or other suitable devices for adjusting position of supports 560-569. The web handling system 400 may also incorporate movement mechanism 610 in a similar manner to adjust positions of supports 460-461.

An interlaced roller configuration refers to a relative position between a roller and a support. As earlier described, the supports 560-569 may occupy the spaces between the rollers 550-559 such that web 120 alternates contact with the supports 560-569 and rollers 550-559 as it travels in the second direction between the turning device 410 and the exit 406. The amount of overlap, or relative distance between a support and a roller along a direction perpendicular to web travel, imparts a corresponding amount of contact/heat between web 120 and the rollers 550-559 as the web 120 travels in the second direction. Though ink applied to the marked side 324 of web 120 may be sufficiently dry so as not to smear by the time it begins to contact the supports 560-569, it may be desirable for a number of reasons to further transfer heat to the web 120 with the rollers 550-559 as web 120 travels in the second direction to condition the web 120 for sufficient print/drying quality.

Thus, the web 120 may be dried via heated contact between the unmarked side 326 of web 120 and a first circumferential portion of each of the rollers 550-559 as the web 120 travels in the first circular direction along the arc. The web 120 may be further dried via heated contact between the marked side 324 of web 120 and a second circumferential portion of each of the first rollers 550-559 as the web 120 travels in the second circular direction along the arc in a reverse direction but which now interleaves in a zigzag pattern between the supports 560-596 and the rollers 550-559. The supports 460-469 may be configured to disengage to a non-interlacing position (e.g., such that supports do not guide web 120 to contact rollers 550-559) for paper threading, roller cleaning, a particular drying application, etc.) and/or adjust the amount of interlacing to cause a corresponding adjustment in contact area or heat applied to web 120.

As shown in FIG. 6, the turning device 410 may be positioned at or near a relative center of enclosure 502 and components are positioned along concentric arcs around the turning device 410 which are spaced from one another in the radial direction 214. For example, the first arc closest to the turning device 410 may include the supports 460-469, the second arc may include the rollers 550-559, and the third arc furthest from the turning device 410 may include one or more infrared heat energy sources 680 to heat the web 120. Each arc may span a substantial circumferential portion of the turning device 410 (e.g., 270 degrees or more). The arc(s) may also comprise semi-circle or circular shaped paths that have a uniform distance from the circumference of the turning device 410 and/or to other arcs. However, alternative arc span amounts, non-uniform arc paths, non-circular arc paths, and combinations of different arcs are possible within dryer 600. Additionally, web handling system 400 and/or dryers 500/600 may implement a different number or combination of components in arc(s) other than that explicitly shown and described.

Figure 7:
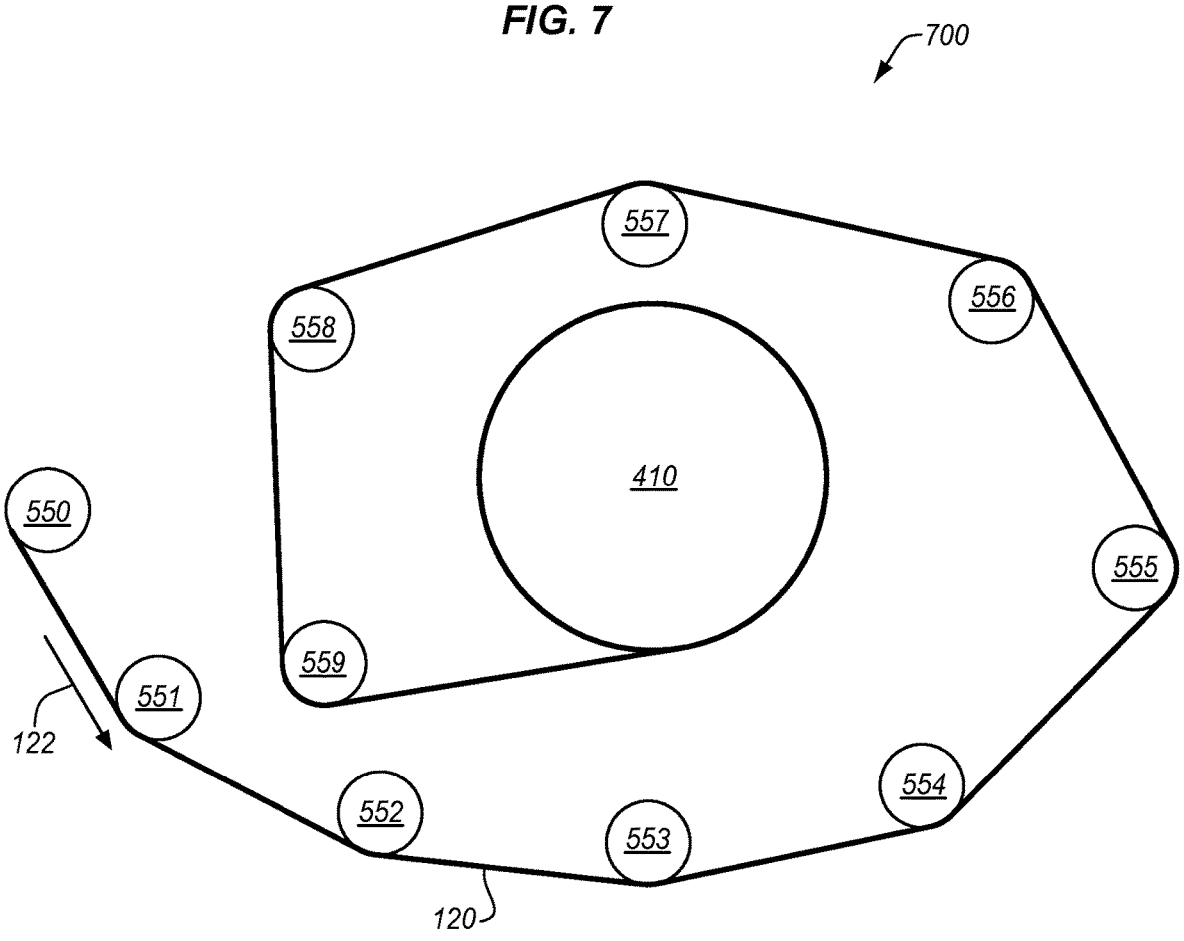
FIG. 7 is a diagram of a dryer with rollers having an increasing web contact area in yet another illustrative embodiment.

FIG. 7 is a diagram of a dryer 700 with rollers having an increasing web contact area in yet another illustrative embodiment. In one embodiment, the rollers 550-559 may be positioned such that the contact area of the web 120 increases on average as the web 120 travels toward the turning device 410. For example, the height of the dryer 700 may be limited and the rollers 550-559 may be positioned in an elliptical configuration (rather than the circular configuration shown in FIGS. 5-6) to fit within the lower dryer profile. As such, there may be one or more rollers (e.g., roller 555) in the middle of the path which have more contact area than one or more subsequent, downstream rollers (e.g., rollers 556-557) because that middle roller may be located proximate to a sharper curve in the elliptical path. Nonetheless, although one or more of the subsequent, downstream rollers may have less contact with the web 120 compared to the previous roller positioned at the curve, the amount of web contact area, on average, increases as the web 120 travels toward the turning device 410.

In one embodiment, the rollers 550-559 are positioned in the dryer 700 such that an amount of contact area between the web 120 and individual ones of the rollers 550-559 increases on a moving average basis as the web 120 travels toward the turning device 410. A moving average basis of a contact area may be defined at each roller as an average of the contact area of the web 120 at that roller and the contact area of the web at each of the previous rollers. As shown in FIG. 7, in some embodiments, one or more additional rollers (e.g., roller 555) may be positioned between a subset or series of rollers (rollers 550-554 and rollers 556-559) that increase web contact area in sequential order. Thus, in this example, the dryer 700 may include multiple series of consecutive rollers that consecutively increase web contact area, and each series may include three or more rollers.

In other embodiments, one or more supplemental rollers that contact and transport the web 120 may be positioned within the series of rollers (e.g., rollers 550-554 or rollers 556-559). For example, one or more supplemental rollers may be located to contact the web between roller 550 and roller 551 (e.g., within the series of rollers 550-552) and/or between roller 556 and roller 557. The one or more supplemental rollers may provide supplemental transport guidance or drying of the web 120. Nonetheless, the series of rollers (e.g., rollers 550-554 or rollers 556-559) may consecutively increase web contact area regardless of the one or more supplemental rollers.

Figure 8:
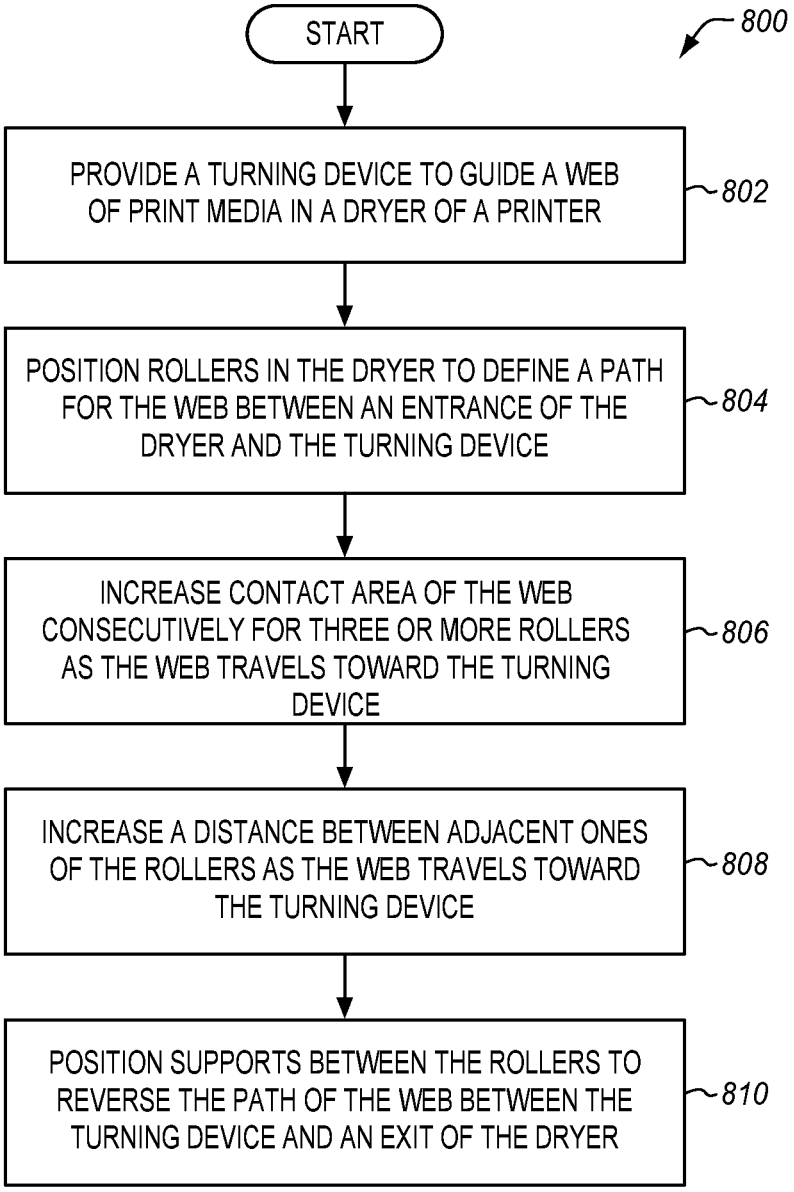
FIG. 8 is a flowchart illustrating a method of heating a web of print media in an illustrative embodiment.

FIG. 8 is a flowchart illustrating a method 800 of heating a web of print media in an illustrative embodiment. The steps of method 800 are described with reference to the dryer 600 of FIG. 6, but those skilled in the art will appreciate that method 800 may be performed in other systems. The steps of the flowcharts described herein are not all inclusive and may include other steps not shown. The steps described herein may also be optionally performed or performed in an alternative order.

In step 802, the turning device 410 is provided to the dryer 600 to guide the web 120. In step 804, the rollers 550-559 are positioned in the dryer 600 to define a path for the web 120 between the entrance 404 and the turning device 410. In step 806, an amount of contact area of the web increases consecutively with three or more of the rollers 550-559 as the web 120 travels toward the turning device 410. In step 808, the distance between adjacent ones of the rollers 550-559 increases as the web 120 travels toward the turning device 410. In step 810, the supports 560-569 are positioned between the rollers 550-559 to reverse the path of the web 120 between the turning device 410 and the exit 406. The supports 560-569 may be adjusted via the movement mechanism 610 to adjust the contact time/amount on rollers 550-559 on the reverse path.

The particular arrangement, number, and configuration of components described herein is non-limiting and provided as example. Although specific embodiments were described herein, the scope of the inventive concepts is not limited to those specific embodiments. The scope of the inventive concepts is defined by the following claims and any equivalents thereof

What is claimed is:

1. A system comprising:

a dryer comprising:

a turning device configured to rotate about an axis;

rollers configured to transport a web of print media from an entrance of the dryer to the turning device, where the turning device is configured to change a traveling direction of the web, and supports configured to transport the web from the turning device to an exit of the dryer, wherein the rollers include a series of three or more rollers positioned in the dryer to consecutively increase an amount of contact area with the web as the web travels toward the turning device.

2. The system of claim 1 wherein:

the rollers are positioned relative to one another such that a distance between adjacent ones of the rollers increases as the web travels toward the turning device.

3. The system of claim 1 wherein:

the rollers are positioned in an arc around the turning device to define a path for the web along the arc between the entrance of the dryer and the turning device, and the supports are positioned along the arc and radially between the rollers and the turning device, the supports configured to reverse the path of the web along the arc between the turning device and the exit of the dryer.

4. The system of claim 3 wherein:

the rollers define the path of the web along the arc in a first circular direction; and the supports define the path of the web along the arc in a second circular direction opposite to the first circular direction.

5. The system of claim 3 wherein:

the supports are positioned relative to one another such that a distance between adjacent ones of the supports decreases as the web travels from the turning device and toward the exit of the dryer.

6. The system of claim 3 wherein:

the rollers are configured to apply heat to the web to dry ink applied to the web, and the supports interlace with the rollers along the arc to transport the web in an alternating fashion with the rollers as the web travels from the turning device and toward the exit of the dryer.

7. The system of claim 6 wherein:

the web contacts a first circumferential portion of each of the rollers as it travels toward the turning device and a second circumferential portion of each of the rollers as it travels from the turning device and toward the exit of the dryer, and the supports are positioned relative to the rollers such that the amount of contact area of the web with the second circumferential portion of each of the rollers increases for each subsequent roller as the web travels from the turning device and toward the exit of the dryer.

8. The system of claim 7 wherein:

one or more of the supports are configured to adjust position relative to a roller to change the amount of contact area of the web with the second circumferential portion of the roller.

9. The system of claim 1 further comprising:

one or more supplemental rollers positioned within the series of three or more rollers and contacting the web as the web travels toward the turning device.

10. The system of claim 1 further comprising:

a continuous-forms printing system that marks the web with ink upstream from the dryer.

11. A web handling system comprising:

a turning device of a dryer configured to rotate about an axis;

rollers of the dryer configured to transport a web of print media from an entrance of the dryer to the turning device, where the turning device is configured to change a traveling direction of the web; and supports of the dryer configured to transport the web from the turning device to an exit of the dryer, wherein the rollers include a series of three or more rollers to consecutively increase an amount of contact area with the web as the web travels toward the turning device.

12. The web handling system of claim 11 wherein:

the rollers are positioned relative to one another such that a distance between adjacent ones of the rollers increases as the web travels toward the turning device.

13. The web handling system of claim 11 wherein:

the rollers are positioned in an arc around the turning device to define a path for the web along the arc between the entrance of the dryer and the turning device, and the supports are positioned along the arc and radially between the rollers and the turning device, the supports configured to reverse the path of the web along the arc between the turning device and the exit of the dryer.

14. The web handling system of claim 13 wherein:

the rollers define the path of the web along the arc in a first circular direction; and the supports define the path of the web along the arc in a second circular direction opposite to the first circular direction.

15. The web handling system of claim 13 wherein:

the supports are positioned relative to one another such that a distance between adjacent ones of the supports decreases as the web travels from the turning device and toward the exit of the dryer.

16. The web handling system of claim 13 wherein:

the rollers are configured to apply heat to the web to dry ink applied to the web, and the supports interlace with the rollers along the arc to transport the web in an alternating fashion with the rollers as the web travels from the turning device and toward the exit of the dryer.

17. The web handling system of claim 16 wherein:

the web contacts a first circumferential portion of each of the rollers as it travels toward the turning device and a second circumferential portion of each of the rollers as it travels from the turning device and toward the exit of the dryer, and the supports are positioned relative to the rollers such that the amount of contact area of the web with the second circumferential portion of each of the rollers increases for each subsequent roller as the web travels from the turning device and toward the exit of the dryer.

18. The web handling system of claim 17 wherein:

one or more of the supports are configured to adjust position relative to a roller to change the amount of contact area of the web with the second circumferential portion of the roller.

19. A method comprising:

providing a turning device in a dryer of a printer to rotate about an axis;

positioning rollers in the dryer to define a path for the web between an entrance of the dryer and the turning device, where the turning device changes a traveling direction of the web;

increasing an amount of contact area of the web consecutively with three or more of the rollers as the web travels toward the turning device; and positioning supports in the dryer to reverse the path of the web between the turning device and an exit of the dryer.

20. The method of claim 19 further comprising:

increasing a distance between adjacent ones of the rollers as the web travels toward the turning device.

21. The method of claim 19 wherein positioning the supports comprises:

positioning the supports between the rollers.

22. A system comprising:

a dryer comprising:

a turning device configured to rotate about an axis;

rollers configured to transport a web of print media from an entrance of the dryer to the turning device, where the turning device is configured to change a traveling direction of the web; and supports configured to transport the web from the turning device to an exit of the dryer, wherein the rollers include a series of three or more rollers positioned such that an amount of contact area between the web and individual ones of the rollers increases on a moving average basis as the web travels toward the turning device.

23. The system of claim 22 wherein:

the rollers are positioned relative to one another such that a distance between adjacent ones of the rollers increases as the web travels toward the turning device.

24. The system of claim 22 wherein:

the rollers are positioned in an arc around the turning device to define a path for the web along the arc between the entrance of the dryer and the turning device, and the supports are positioned along the arc and radially between the rollers and the turning device, the supports configured to reverse the path of the web along the arc between the turning device and the exit of the dryer.

25. The system of claim 24 wherein:

the rollers define the path of the web along the arc in a first circular direction; and the supports define the path of the web along the arc in a second circular direction opposite to the first circular direction.

26. The system of claim 24 wherein:

the supports are positioned relative to one another such that a distance between adjacent ones of the supports decreases as the web travels from the turning device and toward the exit of the dryer.

27. The system of claim 24 wherein:

the rollers are configured to apply heat to the web to dry ink applied to the web, and the supports interlace with the rollers along the arc to transport the web in an alternating fashion with the rollers as the web travels from the turning device and toward the exit of the dryer.

28. The system of claim 27 wherein:

the web contacts a first circumferential portion of each of the rollers as it travels toward the turning device and a second circumferential portion of each of the rollers as it travels from the turning device and toward the exit of the dryer, and the supports are positioned relative to the rollers such that the amount of contact area of the web with the second circumferential portion of each of the rollers increases for each subsequent roller as the web travels from the turning device and toward the exit of the dryer.

29. The system of claim 28 wherein:

one or more of the supports are configured to adjust position relative to a roller to change the amount of contact area of the web with the second circumferential portion of the roller.

30. The system of claim 22 further comprising:

one or more supplemental rollers positioned within the series of three or more rollers and contacting the web as the web travels toward the turning device.

* * * * *